US009130301B2

(12) United States Patent
Lu

(10) Patent No.: US 9,130,301 B2
(45) Date of Patent: Sep. 8, 2015

(54) WATERPROOF ELECTRICAL CONNECTOR AND METHOD FOR MAKING THE SAME

(71) Applicant: HON HAI PRECISION INDUSTRY CO., LTD., New Taipei (TW)

(72) Inventor: Cen Lu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/255,093

(22) Filed: Apr. 17, 2014

(65) Prior Publication Data

US 2014/0315413 A1 Oct. 23, 2014

(30) Foreign Application Priority Data

Apr. 18, 2013 (CN) ..... 2013 1 01351176

(51) Int. Cl.

| | |
|---|---|
| ***H01R 13/64*** | (2006.01) |
| ***H01R 13/52*** | (2006.01) |
| *H01R 13/627* | (2006.01) |
| *H01R 12/72* | (2011.01) |

(52) U.S. Cl.

CPC ..... *H01R 13/521* (2013.01); *H01R 12/724* (2013.01); *H01R 13/5219* (2013.01); *H01R 13/6273* (2013.01)

(58) Field of Classification Search

CPC ..... H01R 13/65802; H01R 13/2442

USPC ..... 439/374, 607.01, 701, 260, 626

See application file for complete search history.

(56) References Cited

U.S. PATENT DOCUMENTS

| | | | | |
|---|---|---|---|---|
| 7,112,087 | B2 | 9/2006 | Tago et al. | |
| 7,682,199 | B2 | 3/2010 | Ahn et al. | |
| 8,801,463 | B2 * | 8/2014 | Tan et al. | 439/607.04 |
| 2013/0183845 | A1 * | 7/2013 | Tan et al. | 439/271 |
| 2014/0315413 | A1 * | 10/2014 | Lu | 439/350 |

FOREIGN PATENT DOCUMENTS

| | | |
|---|---|---|
| CN | 102403618 | 4/2012 |
| JP | 4875130 | 5/2011 |

* cited by examiner

*Primary Examiner* — Phuongchi T Nguyen

(74) *Attorney, Agent, or Firm* — Ming Chieh Chang; Wei Te Chung

(57) ABSTRACT

A waterproof electrical connector (100) includes a number of terminals (2), a metallic shell (1), and an insulating housing (3) molding outside of the metal shell (1) to define a passageway (10). The insulating housing (1) includes a base portion (33), a tongue portion (31) extending forwardly from the base portion (33), and a cover portion (32) extending forwardly from end edges of the base portion (33) for covering the metallic shell (1). The tongue portion (33) includes at least one mold slot (331), the metallic shell includes a mold cavity (124), and the cover portion (32) includes a mold hole (322). The mold slot (331) is aligned with the mold cavity (124) and the mold hole (322) for inserting a mold.

15 Claims, 6 Drawing Sheets

WATERPROOF ELECTRICAL CONNECTOR AND METHOD FOR MAKING THE SAME

BACKGROUND OF THE INVENTION

1. Field of the Invention

The present invention relates generally to a waterproof electrical connector and method for making the same, and more particularly to a waterproof electrical connector having better waterproof function.

2. Description of Related Arts

Universal Serial Bus (USB) innerfaces are widely used in various electronic devices. In recent years, a micro USB innerface is introduced to meet miniaturization requirement of electronic devices. Japan Patent No. 4875130 discloses an electrical connector comprising a metallic shell, a plurality of terminals received in the metallic shell and an insulative housing insert-molded with the metallic shell and the terminals. The metallic shell defines a passageway for inserting a mating connector. The insulative housing comprises a base portion, a tongue portion extending from the base portion and forwardly into the passageway of the metallic shell, and a cover portion extending forwardly from end edges of the base portion for covering the metallic shell by insert-molding. Each terminal includes a contact portion retained in the tongue portion and exposed out of the tongue portion. A method for making the electrical connector comprises steps of: firstly, inserting a first mold in the passageway along an insertion direction and resisting the first mold against one end of the contact poirtion for fixing the terminal Secondly, inserting a second mold in the passageway along an extraction direction opposite to the insertion direction and resisting the second mold against another end of the contact portion for fixing the terminal. Thirdly, forming the insulative housing with the metallic shell and the terminals by insert-molding. However, the electrical connector has poor waterproof/sealing effect, and the insulative housing will easily splinner or crack at a rear end of the tongue portion.

A waterproof electrical connector and method for making the same, the waterproof electrical connector has better waterproof/sealing effect and easily to be made.

SUMMARY OF THE INVENTION

Accordingly, an object of the present invention is to provide a waterproof electrical connector and method for making the same, the waterproof electrical connector has better waterproof/sealing effect and easily to be made.

To achieve the above object, a waterproof electrical connector includes a number of terminals, a metallic shell and an insulating housing molding outside of the metal shell defining a passageway. The insulating housing includes a base portion, a tongue portion extending forwardly from the base portion and a cover portion extending forwardly from end edges of the base portion for covering the metallic shell. The tongue portion includes at least one mold slot, the metallic shell includes a mold cavity and the cover portion includes a mold hole. The mold slot is aligned with the mold cavity and the mold hole for inserting a mold.

Other objects, advantages and novel features of the invention will become more apparent from the following detailed description when taken in conjunction with the accompanying drawings.

DETAILED DESCRIPTION OF THE PREFERRED EMBODIMENT

Figure 1:
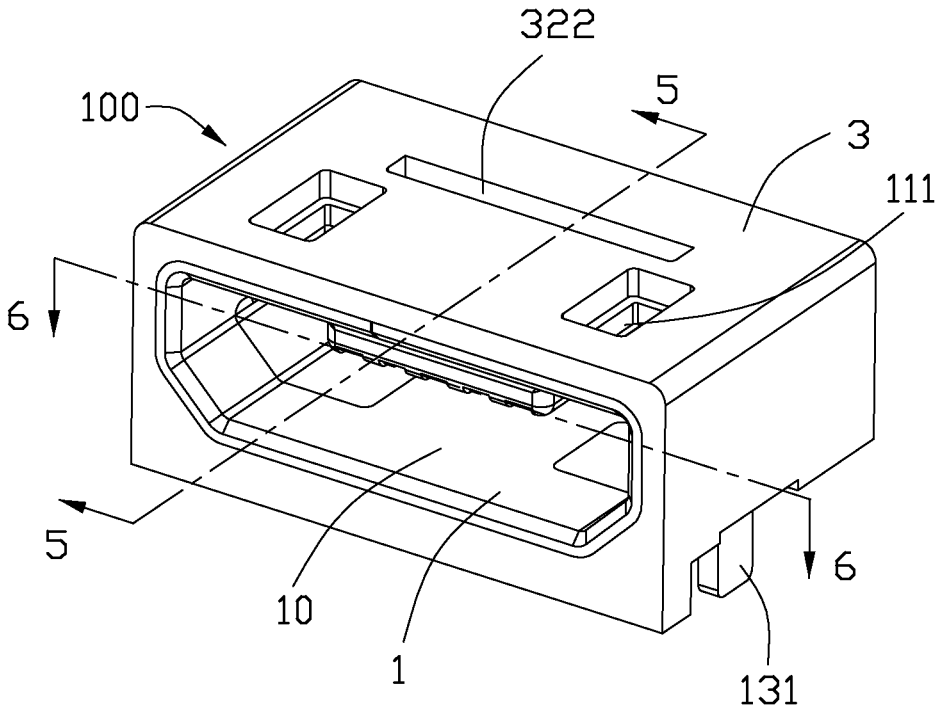
FIG. 1 is a perspective, assembled view of a waterproof electrical connector of the present invention.

Reference will now be made in detail to the preferred embodiment of the present invention.

Referring to FIGS. 1 to 5, a waterproof electrical connector 100 comprises a metallic shell 1, a plurality of terminals 2 partly received in the metallic shell 1 and an insulative housing 3 fixed with the metallic shell 1 and the terminals 2 by insert-molding. The waterproof electrical connector 100 defines an insertion direction and an extraction direction opposite to the insertion direction.

Referring to FIGS. 1 to 5, the metallic shell 1 comprises a bottom wall 12, a top wall 11 facing to the bottom wall 12 and defining a joint 123, a pair of side walls 13 connecting with the bottom wall 12 and the top wall 11, and jointly formed a passageway 10 for inserting a mating connector (not shown). The top wall 11 defines a pair of slots 111 for latching with a pair of latches (not shown) on the mating connector. Each side wall 13 comprises at least one engaging section 131 extending downwardly from a lower edge thereof and perpendicular to the bottom wall 12 for connecting with a PCB (not shown). The bottom wall 12 comprises a pair of retaining legs 121 extending upwardly from a rear end thereof and a cutout 122 between the pair of retaining legs 121. The retaining legs 121 are fixed in the insulative housing 1 by insert-molding for securing the metallic shell 1 with the insulative housing 1. The top wall 11 comprises a mold cavity/slot 124 extending therethrough for inserting a first mold (not shown).

Figure 4:
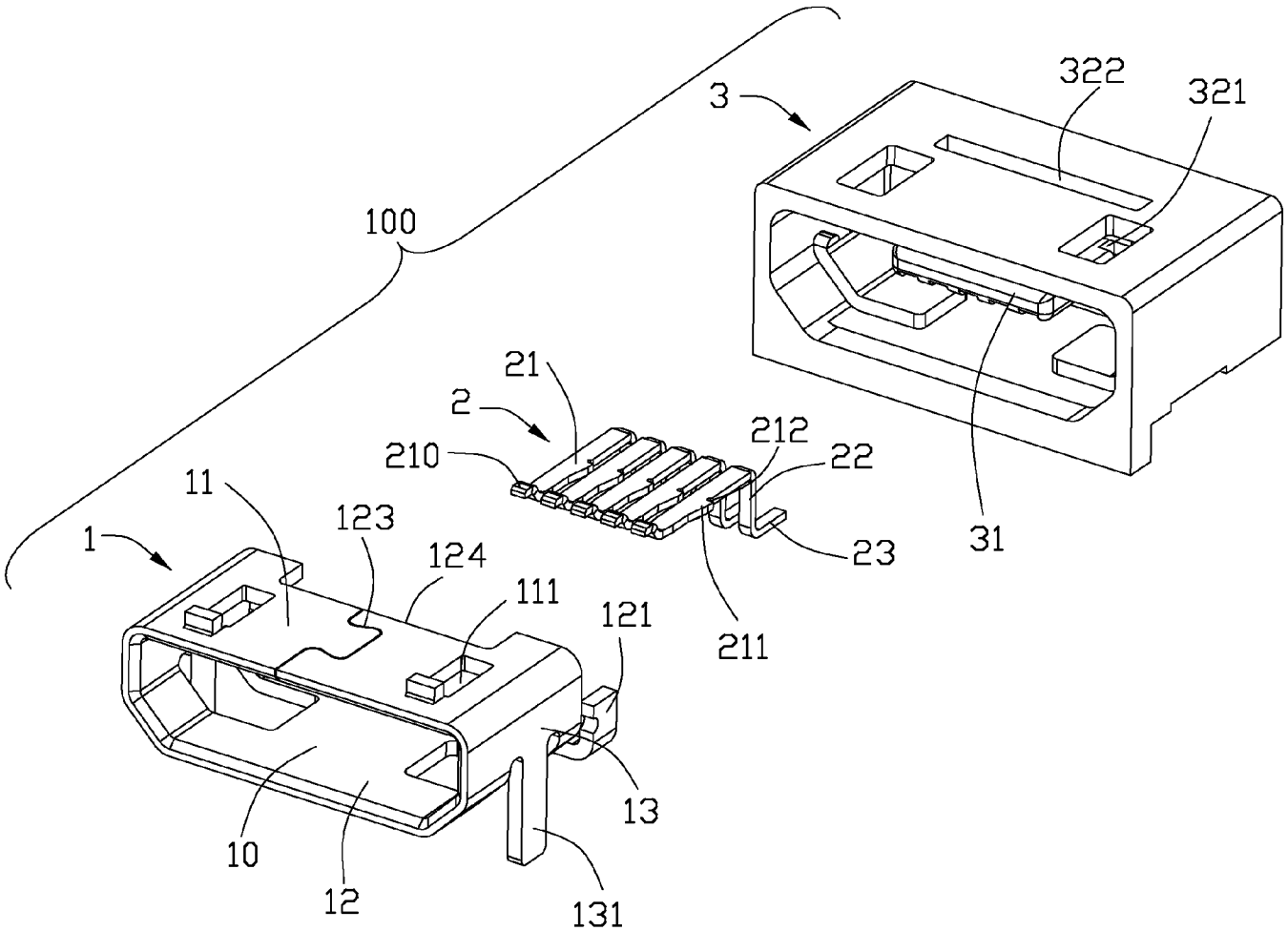
FIG. 4 is a perspective, exploded view of the waterproof electrical connector of the present invention.
Figure 5:
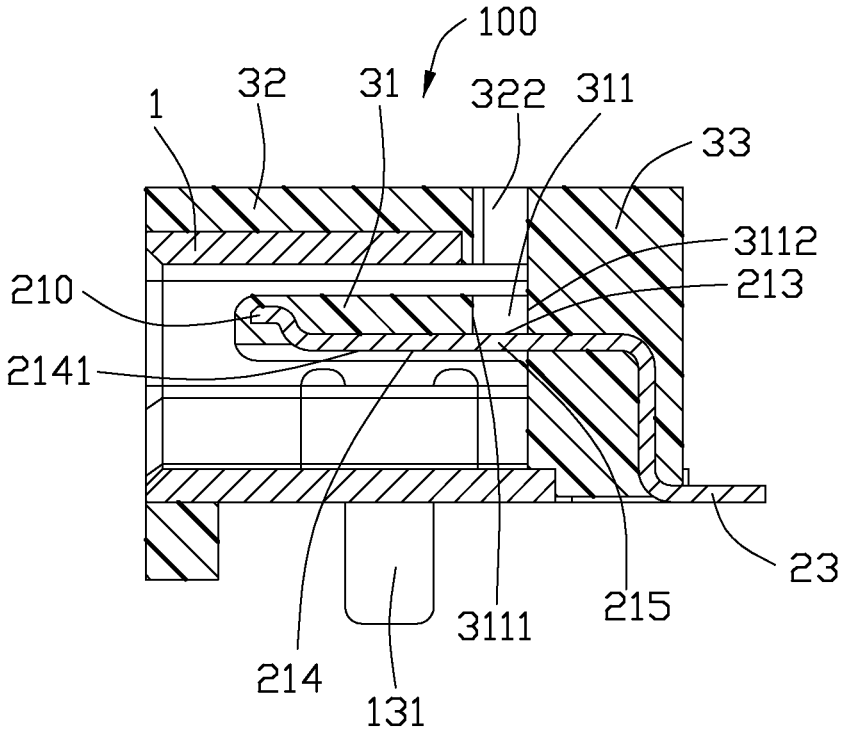
FIG. 5 is a cross-sectional view of the waterproof electrical connector taken along line 5-5 of FIG. 1.
Figure 6:
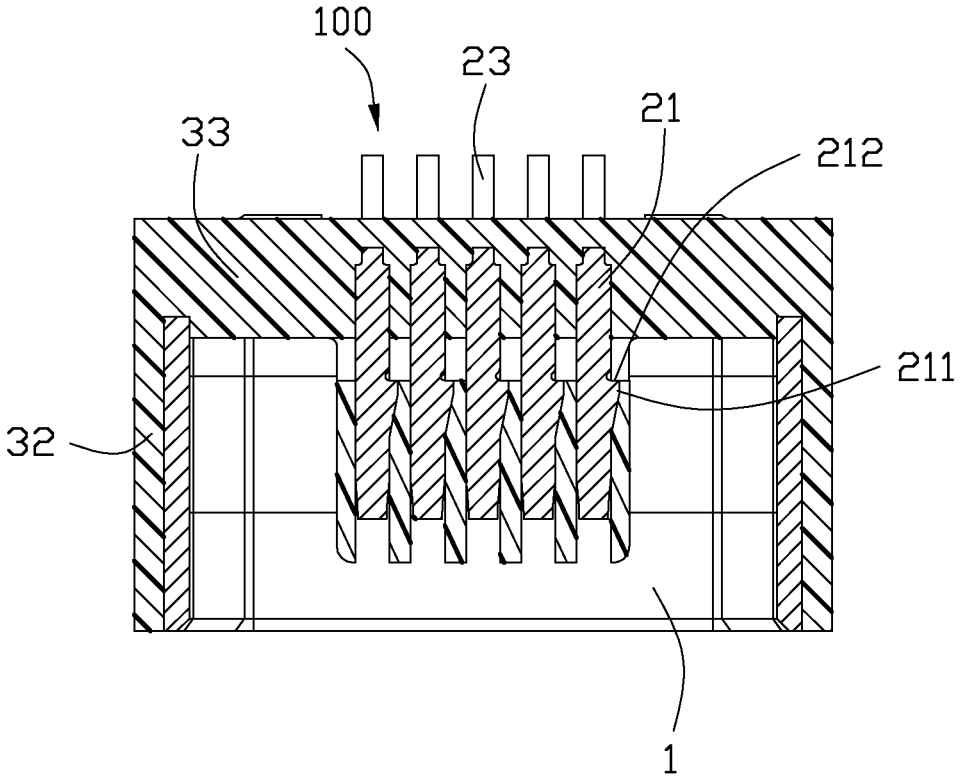
FIG. 6 is a cross-sectional view of the waterproof electrical connector taken along line 6-6 of FIG. 1.

Referring to FIGS. 4 and 5, the terminals 2 are made of metal material. Each terminal 2 comprises a contacting portion 21, a retaining portion 22 extending vertically and downwardly from a rear end of the contacting portion 21 and a soldering portion 23 extending rearwardly from a free end of the retaining portion 22. Each contacting portion 21 includes a Z-shaped end portion 210 at a front end thereof and a protrusion portion 211. The protrusion portion 211 extends from the contacting portion 21 along a width direction and defines a contacting surface 212. The contacting surface 212 faces to a rear end of the waterproof electrical connector 100. In another embodiment of the present invention, the protrusion portion 211 also can extend upwardly from the contacting portion 21. Each contacting portion 21 defines an upper surface 213, a lower surface 214, and a side surface 215 (shown in FIG. 5). In the present invention, each contacting surface 212 is perpendicular to the side surface of the terminal 2 (shown in FIG. 6). The contacting surfaces 212 are pressed against by the first mold for positioning the contacting portions 21 and preventing the terminals 2 from moving rearwardly.

Figure 2:
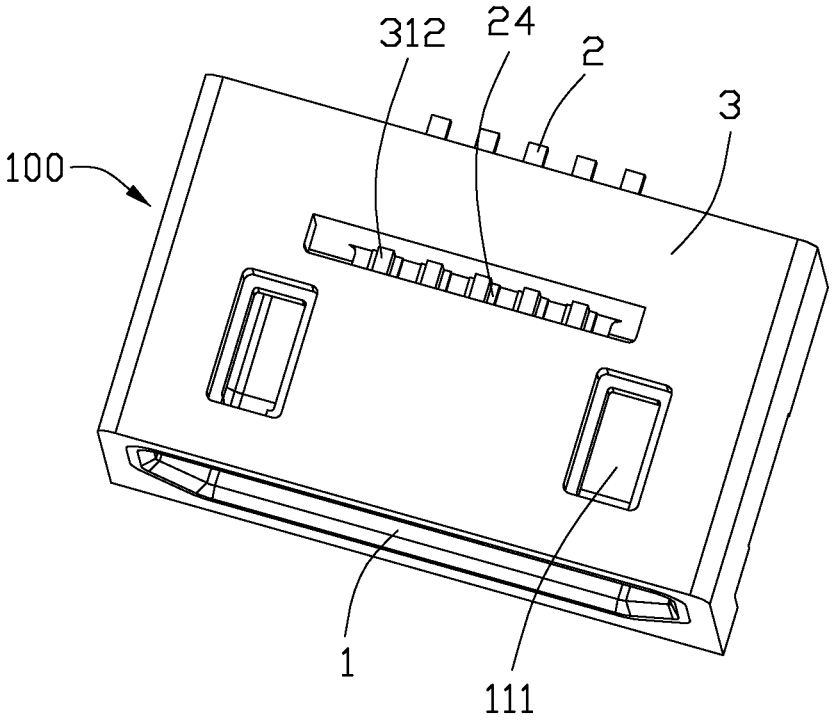
FIG. 2 is another perspective, assembled view of the waterproof electrical connector, taken a different view with respect to FIG. 1.
Figure 3:
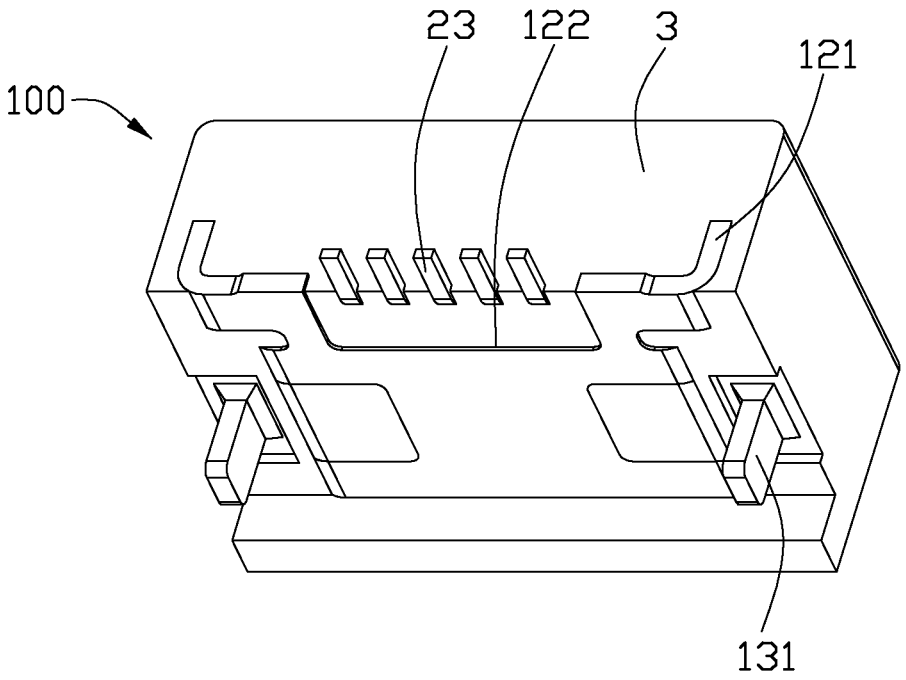
FIG. 3 is another perspective, assembled view of the waterproof electrical connector, taken a different view with respect to FIG. 1.

Referring to FIGS. 1, 2, and 4, the insulative housing 3 is insert-molded with the metallic shell 1 and the terminals 2. The insulative housing 3 comprises a base portion 33, a tongue portion 31 extending from a middle of the base portion 33 and forwardly into the passageway 10 of the metallic shell 3, and a cover portion 32 extending forwardly from end edges of the base portion 33 for covering the metallic shell 1 by insert-molding. The cover portion 32 comprises a pair of holes 321 in communication with the slots 111 for latching with a pair of latches formed on the mating connector. The insulative housing has at least one mold hole 322 (shown in FIG. 4) extending through the cover portion 32 along a first direction perpendicular to the top wall 11 for inserting the first mold. In the present invention, the mold hole 322 is defined adjacent to the base portion 33 and in communication with the mold cavity 124 and the passageway 10. The tongue portion 31 has a plurality of mold slots 311 in communication with the passageway 10 and aligned with the mold hole 322 along a height direction. The tongue portion 31 has a plurality of reinforcing posts 312. Each two adjacent mold slot 311 are spaced apart by the reinforcing post 312. Each reinforcing post 312 covers on the middle of the contacting portion 21 for reinforcing rigidity of the tongue portion. In the embodiment of the present invention, the passageway 10 is formed by the top wall 11, the side walls 13, the bottom wall 12 and the base portion 33.

In the embodiment of the present invention discloses a method for making the waterproof electrical connector 100 comprises steps described below.

Step 1, providing the metallic shell 1 and the plurality of terminals 2. The contacting portion 21 of the terminals 2 are inserted in the passageway 10 from the rear end of the metallic shell 1 along the extraction direction.

Step 2, providing at least one first mold (not shown) inserted into the passageway 10 through the mold cavity 124 along an up-to-bottom direction. The first mold presses against the upper surface 213, the side surface 215 of the contacting portion 21, and the contacting surface 212 of the protrusion portion 211. The first mold is located at the rear end of the contacting portion 21. Inserting at least one second mold (not shown) into the passageway 10 along the insertion direction for pressing against the lower surface of the contacting portion 21. In the embodiment of the present invention, each contacting portion 21 defines a contacting region 24 pressed against by the first mold. The first mold and the second mold are used for positioning the contacting portion 21. In another embodiment of the present invention, the second mold can press against a front end of the end portion 210 for positioning the front portion of the contacting portion 21 and preventing the end portion 210 of the contact portion 21 from being warped.

Step 3, providing at least one third mold (not shown) and/or peripheral mold (not shown) for positioning the metallic shell 1. Step 4, forming the insulative housing by insert-molding. Cutting off material strip (not shown) of the metallic shell 1 and the terminals 2, lastly removing the first mold, the second mold, the third mold and the peripheral mold, and defining the mold hole 322 and the mold slot 311. In the embodiment of the present invention, a front surface (not shown) of the base portion 33 is constituted into an inner surface (not shown) of the mold slot 311.

Referring to FIGS. 1 to 4, the contacting regions 24 of the terminals 2 are located in the tongue portion 31 of the insulative housing 3 and exposed outwardly via the mold cavity 331, the mold cavity 124 and the mold slot 311 along the first direction perpendicular to the top wall 11.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A waterproof electrical connector comprising: a metallic shell; a plurality of terminals partly received in the metallic shell, each terminal comprising a contacting portion, a retaining portion extending downwardly from a rear of the contacting portion, and a soldering portion extending rearwardly from the retaining portion, each contacting portion comprising a contacting region pressed against by a first mold; and an insulative housing insert-molded with the metallic shell and the terminals, the insulative housing comprising a base portion, a tongue portion extending forwardly from the base portion, and a cover portion extending forwardly from end edges of the base portion and at least partly covering the metallic shell, the tongue portion having at least one mold slot for positioning the first mold, the cover portion having at least one mold hole extending therethrough along a height direction and in communication and alignment with the mold slot along the height direction, the contacting region exposed outwardly via the at least one mold slot and the at least one mold hole along the height direction; wherein, the metallic shell includes a bottom wall, a top wall facing to the bottom wall, and a pair of side walls connecting with the bottom wall and the top wall; the insulative housing includes a base portion; the tongue portion extends from the base portion;

the bottom wall, the side walls, the top wall, and the base portion together define a passageway;

the top wall includes a mold cavity extending therethrough along the height direction; and the mold cavity is aligned with the at least one mold slot and in communication with the mold cavity and the passageway; wherein the tongue portion has a plurality of reinforcing posts each covering a middle of the contacting portion for reinforcing rigidity of the tongue portion, the reinforcing posts dividing the at least one mold slot into several parts.

2. The waterproof electrical connector as claimed in claim 1, wherein the contacting portion defines an upper surface, a lower surface, and a side surface, and the contacting region includes at least part of the upper surface and the side surface.

3. The waterproof electrical connector as claimed in claim 2, wherein a front surface of the base portion constitutes an inner surface of the at least one mold slot.

4. The waterproof electrical connector as claimed in claim 1, wherein each contacting portion includes a protrusion portion and defines a contacting surface exposed outwardly from the insulative housing, the contacting surface facing rearwardly for being pressed against by the first mold.

5. The waterproof electrical connector as claimed in claim 4, wherein the contacting surface of the protrusion portion is perpendicular to a side surface of the terminal.

6. The waterproof electrical connector as claimed in claim 4, wherein the protrusion portion extends from the contacting portion along a width direction.

7. A method for making a waterproof electrical connector, comprising the steps of:

providing a metallic shell and a plurality of terminals, the metallic shell defining a passageway and having a mold cavity in communication with the passageway, each terminal defining a contacting region and comprising a contacting portion, a retaining portion extending downwardly of the contacting portion, and a soldering portion extending rearwardly from the retaining portion;

inserting the contacting portions of the terminals in the passageway from a rear end of the metallic shell along an extraction direction, each contacting portion of the terminal defining an upper surface, a lower surface, and a side surface;

inserting a first mold in the passageway along a height direction through the mold cavity to press against a rear portion of the contacting portion;

inserting a second mold in the passageway along an insertion direction to press against the lower surface of the contacting portion;

insert-molding an insulative housing, cutting off material strips of the metallic shell and the terminals, and removing the first mold and the second mold to define a mold slot and a mold hole, the insulative housing comprising a base portion, a tongue portion extending forwardly from the base portion, and a cover portion extending forwardly from end edges of the base portion and at least part covering the metallic shell, the contacting portion retained in the tongue portion and exposed outwardly from the tongue portion, the retaining portion retained in the base portion, the soldering portion extending outwardly from the insulative housing, the mold slot located at the tongue portion of the insulative housing, the contacting region exposed outwardly via the mold slot, the mold cavity, and the mold hole; wherein the step of inserting the first mold comprises pressing the first mold against an outwardly-exposing, protruding contacting surface of the contacting portion.

8. An electrical connector comprising: a metallic shell defining a passageway surrounded by opposite top and bottom walls in a vertical direction, and opposite lateral side walls in a transverese direction perpendicular to said vertical direction;

an insulative housing unitarily forming a rear base portion, a tongue portion forwardly extending from the base portion in a front-to-back direction perpendicular to both said vertical direction and said transverse direction, and received in the passage, and a cover portion forwardly extending from the base portion and enclosing the shell therein; and a plurality of contacts integrally formed with the tongue portion and the base portion, each of said contacts defining a horizontal section with a contacting sections exposed upon the tongue portion, a tail section extending out of the rear base portion for mounting to a printed circuit board, and a connecting sections linked between the horizontal section and the tail section and fully embedded within the base portion without exposure; wherein in alignment with a specific position of the contacting section of each of the contacts in a vertical direction, the cover portion forms a mold hole, the shell forms a mold cavity, and the tongue portion forms a mold slot so as to allow a mold piece to extend therethrough in the vertical direction with one end abutting against the contacting section of the corresponding contact during an insert molding process of integrally forming the housing with both the shell and the contacts;

wherein the shell further forms a pair of latch slots for locking with a pair of corresponding latches of a complementary plug connector, and the cover portion forms a pair of holes in alignment with the corresponding latch slots, respectively, in the vertical direction; wherein the mold slot is formed at a root of said tongue portion.

9. The electrical connector as claimed in claim 8, wherein the specific position of each of said contacts is located at a same location in the front-to-back direction so that the mold holes of the cover portion are unified together in the transverse direction as a large one mold hole.

10. The electrical connector as claimed in claim 8, wherein the specific position of each of said contacts is located at a same location in the front-to-back direction so that the mold cavities of the shell are unified together in the transverse direction as one large mold cavity.

11. The electrical connector as claimed in claim 8, wherein the specific position of each of said contacts is located at a same location in the front-to-back direction so that the mold slots of the tongue are unified together in the transverse direction as one large mold slot.

12. The electrical connector as claimed in claim 8, wherein the contacting section forms a rearward contacting surface communicating with the corresponding mold slot for abutment with the mold piece during the insert molding process to prevent rearward movement of the corresponding contact.

13. The electrical connector as claimed in claim 8, wherein the connecting section forms an L-shape configuration.

14. The electrical connector as claimed in claim 8, wherein the shell forms a pair of downward extending engaging sections exposed to an exterior for mounting to the printed circuit board, and a pair of retaining legs embedded with the base portion.

15. The electrical connector as claimed in claim 14, wherein the shell forms a pair of openings due to the pair of engaging sections, and said pair of openings are occupied by the covering portion.

* * * * *